US006930234B2

(12) United States Patent
Davis

(10) Patent No.: US 6,930,234 B2
(45) Date of Patent: Aug. 16, 2005

(54) ADJUSTABLE KEYBOARD APPARATUS AND METHOD

(76) Inventor: Lanny Davis, 105 Forest Fern Rd., Columbia, SC (US) 29212

( * ) Notice: Subject to any disclaimer, the term of this patent is extended or adjusted under 35 U.S.C. 154(b) by 38 days.

(21) Appl. No.: 10/463,990

(22) Filed: Jun. 18, 2003

(65) Prior Publication Data

US 2004/0025673 A1 Feb. 12, 2004

Related U.S. Application Data

(60) Provisional application No. 60/390,053, filed on Jun. 19, 2002.

(51) Int. Cl.[7] ..... G10C 3/12

(52) U.S. Cl. ..... 84/423 R; 84/427; 84/434; 84/435; 84/436; 84/440

(58) Field of Search ..... 84/423 R, 427, 84/434, 435, 436, 440

(56) References Cited

U.S. PATENT DOCUMENTS

| | | | | |
|---|---|---|---|---|
| 2,614,153 | A | | 10/1952 | Enochs et al. |
| 3,270,608 | A | | 9/1966 | Rhodes |
| 3,943,812 | A | | 3/1976 | Nagai et al. |
| 4,044,642 | A | | 8/1977 | Pearlman et al. |
| 4,099,439 | A | | 7/1978 | Luce |
| 4,102,233 | A | | 7/1978 | Kern |
| 4,111,091 | A | | 9/1978 | Hinago |
| 4,217,803 | A | | 8/1980 | Dodds |
| 4,314,494 | A | | 2/1982 | De Vries |
| 4,375,179 | A | | 3/1983 | Schwartz et al. |
| 4,418,605 | A | | 12/1983 | Tollefsen et al. |
| 4,474,100 | A | | 10/1984 | Kondo |
| 4,562,764 | A | | 1/1986 | Marshall |
| 4,580,478 | A | | 4/1986 | Brosh et al. |
| 4,628,786 | A | | 12/1986 | Buchla |
| 4,649,784 | A | | 3/1987 | Fulks et al. |
| 4,667,563 | A | | 5/1987 | Wakuda et al. |
| 4,679,477 | A | | 7/1987 | Monte |
| 4,685,371 | A | | 8/1987 | Levinson |
| 4,704,931 | A | | 11/1987 | Nagai et al. |
| 4,768,412 | A | | 9/1988 | Sanderson |
| 4,838,139 | A | | 6/1989 | Fiori, Jr. |
| 4,890,533 | A | | 1/1990 | Katsuta et al. |
| 4,899,631 | A | | 2/1990 | Baker |
| 4,901,614 | A | | 2/1990 | Kumano et al. |
| 4,974,482 | A | | 12/1990 | Tamaki et al. |
| 4,993,305 | A | | 2/1991 | Franz et al. |
| 5,003,859 | A | | 4/1991 | Monte et al. |
| 5,036,743 | A | | 8/1991 | Yamaguchi et al. |
| 5,164,532 | A | | 11/1992 | Ishii et al. |
| 5,200,562 | A | | 4/1993 | Kaneko et al. |
| 5,243,125 | A | | 9/1993 | Yamaguchi |
| 5,249,497 | A | | 10/1993 | Niitsuma |
| 5,571,983 | A | | 11/1996 | Yamaguchi et al. |
| 5,574,241 | A | | 11/1996 | Kumano et al. |
| 5,578,782 | A | | 11/1996 | Masubuchi |
| 5,610,352 | A | | 3/1997 | Yamaguchi |
| 5,610,356 | A | | 3/1997 | Koseki et al. |
| 5,696,340 | A | | 12/1997 | Ragni |
| 5,763,799 | A | | 6/1998 | Kimble |
| 5,796,023 | A | | 8/1998 | Kumano et al. |
| 5,945,617 | A | | 8/1999 | Niitsuma |
| 6,060,653 | A | * | 5/2000 | Willis ..... 84/433 |
| 6,191,351 | B1 | | 2/2001 | Niitsuma |
| 6,329,585 | B1 | | 12/2001 | Chono |
| 2001/0017075 | A1 | | 8/2001 | Meisel |
| 2001/0037723 | A1 | | 11/2001 | Nishida et al. |

* cited by examiner

*Primary Examiner*—Shih-Yung Hsieh
(74) *Attorney, Agent, or Firm*—Roger M. Rathbun

(57) ABSTRACT

A keyboard apparatus for musical instruments such as pianos, organs, clavichords, and harpsichords, and methods for making and using the apparatus. The apparatus includes a frame assembly, a plurality of keys, a plurality of lever assemblies each operably connected with its corresponding key, and a main fulcrum that together replicate the touch of an acoustic piano keyboard. It can be used in electronic and acoustic instruments, can be adjusted to simulate the feel of a selected type of keyboard instrument, and is simple and cost-effective to manufacture.

20 Claims, 13 Drawing Sheets

Fig.6
Fig.6A
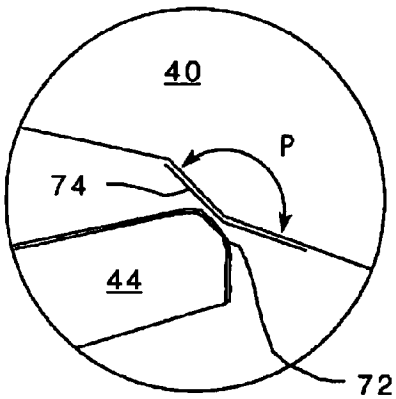
Fig 6B
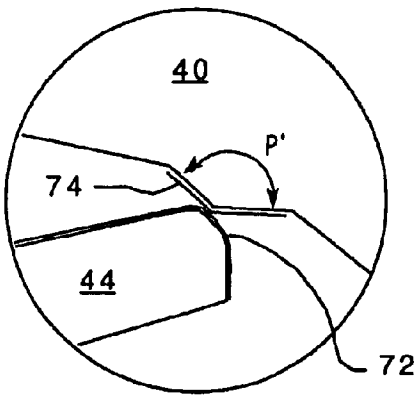
Fig.6C
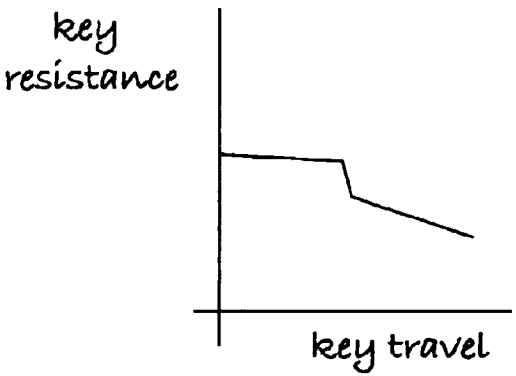
Fig.6D

ADJUSTABLE KEYBOARD APPARATUS AND METHOD

RELATED APPLICATIONS

The present patent application is based upon U.S. Provisional Patent Application Ser. No. 60/390,053 filed Jun. 19, 2002 and entitled "Adjustable Keyboard Apparatus and Method".

BACKGROUND OF THE INVENTION

1. Field of the Invention

The present invention relates to a keyboard apparatus for musical instruments such as pianos, organs, clavichords, and harpsichords. In particular, the present invention relates to a user-adjustable keyboard apparatus that simulates the touch and feel of an acoustic keyboard instrument, and that can be used in electronic keyboard instruments. The present invention further relates to a user-adjustable keyboard apparatus that can simulate the feel of a selected type of keyboard instrument, and that is simple and cost-effective to manufacture, and to methods for making and using the apparatus.

2. Discussion of the Background

Keyboard instruments, particularly pianos and organs, have been described as the most versatile of all musical instruments due to the extraordinary range of music they can produce. Present-day pianos and organs represent the culmination of centuries of developments aimed at improving the tonal quality, volume, sustainability, dynamic range, and reproducibility of the musical sounds (also termed "notes" or "tones") produced by these instruments. The best instruments allow an accomplished player to perform virtually any kind of musical composition, in virtually any style, ranging from gentle to forceful, from soft or loud, and from slow to fast.

Electronic keyboards represent a recent development in musical instrument design. Electronic keyboards are becoming increasingly popular among both amateur and professional performers due to their versatility, portability, compactness, and relatively low cost when compared to acoustic instruments. These keyboards can be programmed to generate sounds that simulate a variety of acoustic keyboard instruments (piano, organ, harpsichord, clavichord, etc.) as well as other musical instruments. With the appropriate hardware and software, it is possible to program an electronic keyboard to produce virtually any desired types of output sounds. Most electronic keyboards are much smaller and lighter than a conventional piano or organ, and are therefore easier to transport between gigs or when the owner is moving to a different residence.

For many performers, a major drawback of electronic keyboards is that they simply do not "feel" the same as conventional keyboard instruments when played. In a conventional acoustic piano the player depresses a key to initiate a mechanical operation that produces a music sound. The force applied to the key is transmitted to a hammer through a whippen and a jack assembly, and the hammer strikes a metal string (or strings) to produce the sound. The loudness and tonal quality of the sound produced by each struck key depends on the force applied to the key when the player depresses it, the number of strings struck by the hammer (and the properties of those strings), and whether or not the player depressed any pedals while striking the key (typical pianos have two foot pedals: a "loud" or "sustain" pedal and a "soft" or "mute" pedal). Different musical sounds are produced by striking individual keys with varying degrees of force, by striking combinations of keys to produce chords, by rapidly striking the same key in succession, by rapidly stroking many keys in succession with the back of the thumb to produce a glissando, etc.

The overall "touch" or "feel" of an acoustic piano keyboard results from a combination of the individual player's technique and the complex interaction of a large number of moving parts that together constitute the piano action (for purposes of this specification, the terms "touch" and "feel" refer to the totality of the player's experience when playing a keyboard instrument). The mechanism of an organ, while different from that of a piano, also results in a particular touch experienced by the player. Indeed, each acoustic piano has a unique character and touch, so that players who are shopping for a piano will frequently try out several before selecting that one which best fits their individual preferences.

In an electronic keyboard, depressing a key operates a sensor, switch, or other device associated with a tone generator, resulting in a completely different touch from that experienced with a conventional piano or organ. While different keys produce different sounds, the variation that a player can impart to the sound generated upon striking a particular key is much less than that experienced with a piano.

One of the goals of electronic keyboard design has been to produce a keyboard that simulates the touch of a conventional piano or organ as closely as possible: the individual keys must be balanced, they must not be too easy to depress (or offer too much resistance to depression), and they must be capable of producing different sounds, ranging from loud to soft and from short to sustained, depending on how they are struck by the player. Attempts to address these requirements typically involve the addition of electronic components that sense the duration and force of each keystroke, resulting in increasingly complex and expensive devices that nevertheless fail in comparison to acoustic keyboards. Even state-of-the art electronic keyboards cannot reliably produce embellishments such as staccatos and glissandos: many keyboards simply do not respond adequately to the fast, light touch of a staccato, and none have the flexibility that is needed for a player to execute a good glissando. Despite the many different types of electronic keyboards available to consumers, no known design completely and consistently simulates the touch of a conventional piano or organ keyboard. Thus, many players, both amateurs and professional musicians, remain convinced that electronic keyboard instruments lack the user-friendliness and versatility they prize in their favorite acoustic instruments.

Accordingly, there is a need for a keyboard action that reliably simulates the touch of a conventional piano or organ keyboard, and that allows a player to execute staccatos, glissandos, and like embellishments. Preferably, such an action would be adjustable both to suit the individual player's preferences and to simulate the touch of different types of instruments (piano, organ, etc.), and would be simple and cost-effective to manufacture.

SUMMARY OF THE INVENTION

According to its major aspects and broadly stated, the present invention includes a keyboard apparatus for musical instruments such as pianos, organs, clavichords, and harpsichords, and methods for making and using the apparatus. The apparatus is of the type know in the art as a "folded" key action, and includes a frame assembly, a plurality of keys, a plurality of floating lever assemblies each operably connected and registered with a corresponding key, a main fulcrum rail, and, optionally, a lifting mechanism for changing the overall touch and feel of the keyboard from that of a "piano" type to that of an "organ" or "synthesizer" type. The apparatus can be used in both electronic and acoustic instruments, can be adjusted to simulate the feel of a selected type of keyboard instrument, and is simple and cost-effective to manufacture.

An important feature of the present invention is the floating lever assembly, which includes a main bearing, a key lever, a whippen lever, and a hammer lever. The main bearing replicates the effect of the fulcrum (also termed the balance rail) of a mechanical acoustic grand piano action. It allows for upward and downward movement of the keys, but substantially prevents lateral or side-to-side movement; it also eliminates the need for the front felt washers and guide pins found in many key-actions. The key lever is permanently attached to the underside of its corresponding key, and imparts and shares responsive motion to and with its associated levers (i.e., the whippen lever and the hammer lever) to operate the key. Unlike a conventional keyboard instrument, the pivot points of the floating lever assembly are not fixed but rather move with their respective keys, allowing the elimination of the conventional chassis or keyframe assembly found in these instruments.

Another feature of the present invention is the flexible bearings which connect the key lever and the whippen lever, and the whippen lever and the hammer lever. The bearings impart a degree of hysteresis to the relative motion of the levers of the floating lever assembly, thereby helping replicate the feel of an acoustic piano key-action for the player.

Still another feature of the present invention is ability to adjust the response of the apparatus using the main fulcrum rail, which is movable with respect to the main bearing joist to change the physical inertial response of the keys, and the lifting mechanism which changes the touch from that of an acoustic piano to that of an organ or synthesizer. In one embodiment, either or both of the main fulcrum rail and the lifting mechanism can be adjusted virtually "on the fly" to change the response of the apparatus to suit the player's preference (or indeed to suit the music being played).

Yet another feature of the present invention is the ability to include keyswitch sensors (commonly referred to as "MIDI record strips"), including but not limited to readily-available, off-the-shelf keyswitch sensors, in the apparatus as may be desired. An extra downward depression of the natural or sharp keys can be effected by applying additional pressure once a key has been struck or played. Some MIDI record strips are capable of reading this additional differential movement and interpolating "after touch" controller data.

Another feature of the present invention is the versatility of the apparatus and its ease of manufacture. The apparatus can simulate the feel of virtually any keyboard instrument (including but not necessarily limited to acoustic pianos, harpsichords, clavichords, organs, and synthesizers). It is simple and straight-forward to manufacture; by eliminating the chassis found in many conventional instruments, the number of manufacturing steps and components are greatly reduced. Indeed, the major components of the apparatus can be cut using only two-dimensional X-Y cuts.

Other features and advantages of the present invention will be apparent to those skilled in the art from a careful reading of the Detail Description of Preferred Embodiments presented below and accompanied by the drawings.

BRIEF DESCRIPTION OF THE DRAWINGS

In the drawings:

FIGS. 6A, 6B, 6C and 6D show the effect of the surface profiles of the hammer lever and the key lever mount on key travel;

DETAILED DESCRIPTION OF THE PREFERRED EMBODIMENTS

Figure 1A:
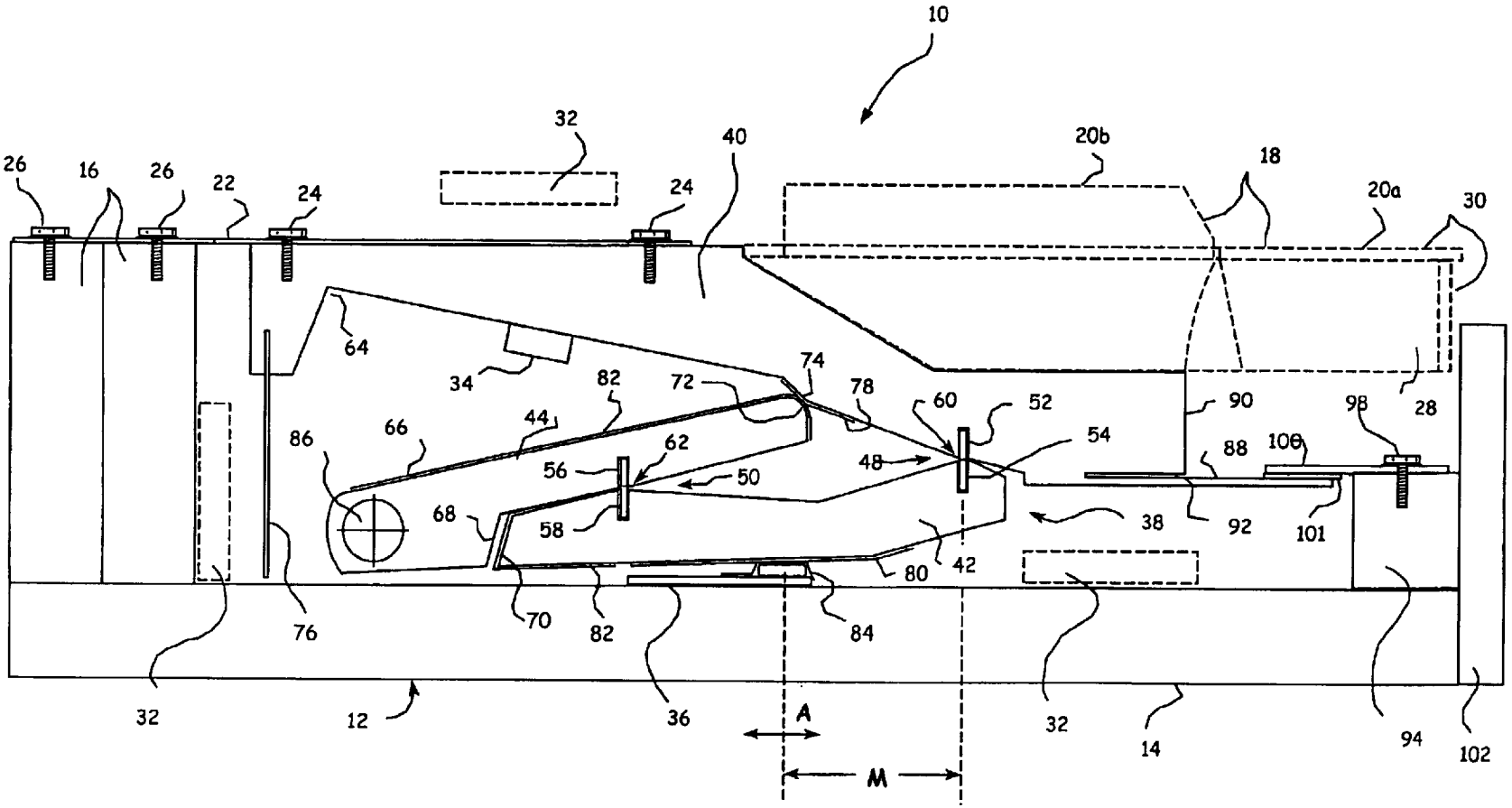
FIG. 1A is a side, partial cross-sectional view of an adjustable keyboard apparatus according to a preferred embodiment of the present invention, showing a white key in the rest position.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. §112. As used herein, the terms "horizontal," "vertical," left," "right," "up," "down," as well as adjectival and adverbial derivatives thereof, refer to the relative orientation of the illustrated structure as the particular drawing figure faces the reader.

Referring now to FIGS. 1A, 1B, 2A and 2B, there is shown an adjustable keyboard apparatus 10 constructed in accordance with a preferred embodiment of the present invention. The keyboard apparatus 10 includes a frame assembly 12 having a generally horizontal base 14 and an upright main joist 16, made of wood, plastic, or other suitable materials. As shown, the main joist 16 is comprised of a pair of wooden members secured together, by means such as glue, in a side-to side relationship, however there may be other means of constructing the main joist 16 as will later be explained. Main joist 16 is attached to base 14 by nails, screws, adhesives, or other suitable fastener. Alternatively, main joist 16 may be integrally formed with base 14.

Figure 1B:
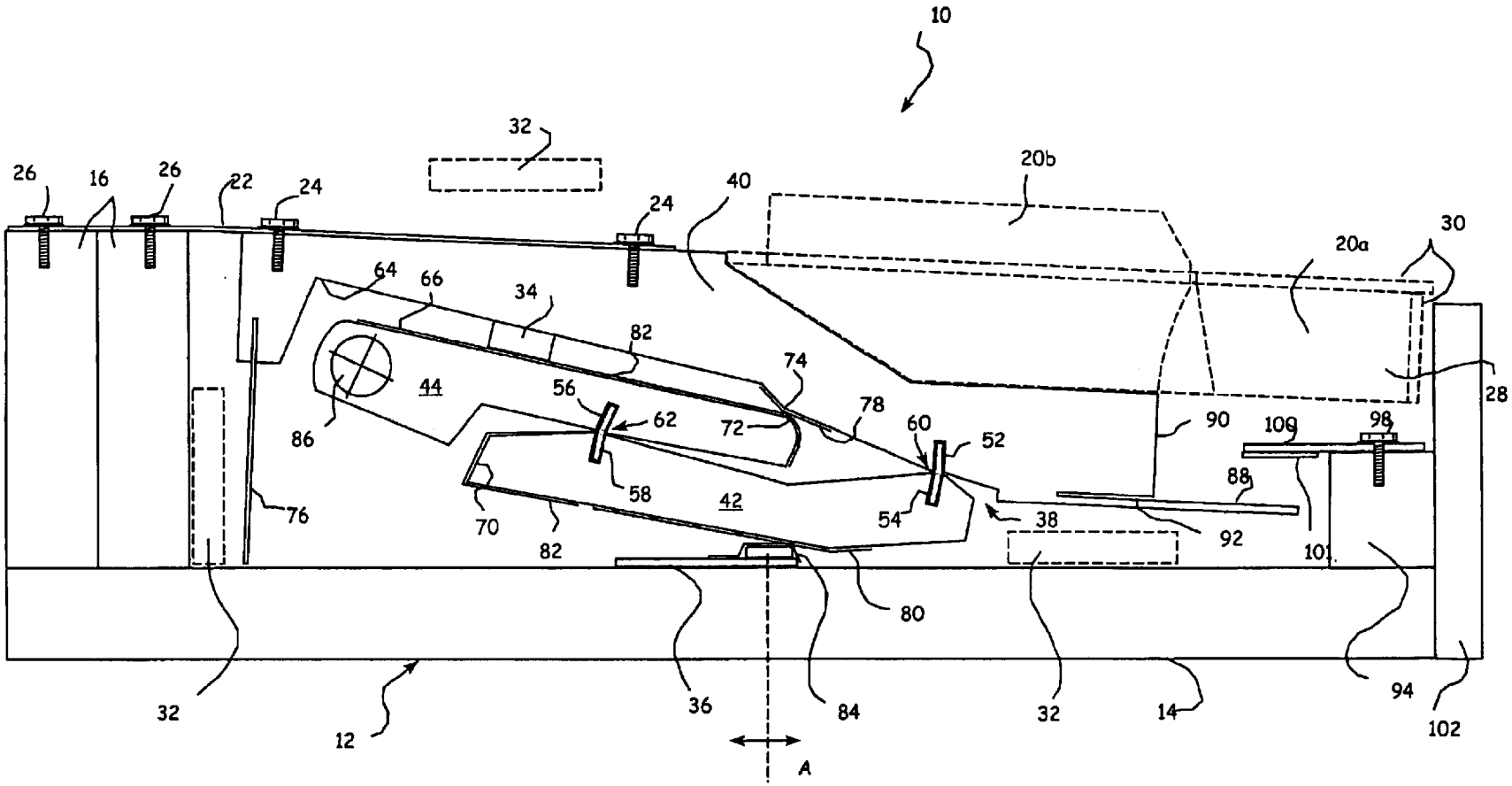
FIG. 1B shows the key of FIG. 1A in the down position.

A plurality of keys 18, more specifically, illustrated as a white key 20*a* and a black key 20*b* are shown in FIGS. 1A and 1B, are arranged side by side on the upper surface of base 14. Each key 18 is attached to a main bearing or support 22 by at least two screws 24 or other suitable fasteners. Supports 22 are attached to main joist 16 also by at least two screws 26. Using at least two screws 24 to fasten each key 18 to support 22, and at least two additional screws 26 to fasten each support 22 to main joist 16 substantially prevents lateral movement of supports 22 (and twisting of keys 18 with respect to frame assembly 12) when the keyboard apparatus 10 is in use. However, keys 18 may move vertically or "up" and "down" somewhat with respect to frame assembly 12 when depressed and released. The degree of such movement depends on the size, weight, and rigidity of keys 18 and supports 22. Thus, the desired amount of such movement can be achieved by a modest degree of experimentation with the materials and dimensions of the components of keyboard apparatus 10.

Keys 18 may be made of any suitable materials including wood, molded plastic, and combinations of these materials while support 22 is preferably metal, although sturdy plastics or composites may also be suitable. Forward ends 28 of the white keys 20*a* may be covered with veneers 30 of plastic or other suitable material that simulates the look of traditional ivory-veneered keys.

Motion sensors, electrical or mechanical switches, keyswitch assemblies of the type commonly referred to as "MIDI strips," or other useful sensing devices may be mounted to base 14 and/or main joist 16, or above the keys 18 and are indicated schematically as sensors 32. The sensors 32 sense the motion of the keys 18 and can, therefore, be positioned at differing locations where that movement can be detected and the sensors 32 are commercially available devices that create the MIDI data to determine the characteristic of the sound produced by the user in activating any of the keys 18.

In order to limit the downward movement of keys 20, a felt downstop 34 may be affixed to the underside of the keys 18 to limit the lower movement of the keys 18.

The overall dimensions, including the length, of keys 18 may vary depending on such factors as the materials and dimensions of frame assembly 12 and the other components of keyboard apparatus 10. The dynamic response of keys 18 may depend partly on their overall length; if desired, such variations may be compensated for by changing the placement of a main fulcrum rail 36, the function of which will be later explained. The optimum dimensions of keys 18 and the other components of keyboard apparatus 10 are best determined by a modest degree of experimentation and observation.

A floating lever assembly 38 for applying force to keys 18 includes a key lever 40 attached to each key 18, a first, or whippen lever 42 and a second, or hammer lever 44. Like keys 18, the components of floating lever assembly 38 may be made of any suitable materials, including wood, plastic, and composite materials. For cost-effective manufacturing, key lever 40, whippen lever 42, and hammer lever 44 can be cut using only X-Y cuts; no Z-cuts are needed. Each floating lever assembly 38 is positioned to be in registration with one of keys 18.

As can be seen in FIGS. 1A and 1B, the key lever 40 is preferable constructed so as to be cut with only x-y cuts and has a basically straight component that has the key 18 affixed thereto, such as being glued thereto, such that the key 18 is thereby affixed to the upper surface of the key lever 40. The difficulty is that normal piano keys are straight at the center of the keyboard but are curved or arcuate as the keyboard progresses further toward the bass or treble keys and, therefore, the curved keys are not suitable for the electronic type of keyboard where all of the keys are designed to be straight and the curved keys are not only unnecessary but are undesirable. Thus, by affixing the keys 18 to the top of the key levers 40, the normally straight keys can be used and which are readily available by being cut out of standard keys, such that the cutting process eliminates the curved portion of any of the keys and all of the normal acoustic piano keys can be used with the present invention Whippen lever 42 is connected to key lever 40 and hammer lever 44 by lever bearings 48, 50, respectively. Lever bearing 48 is installed intermediate a transverse groove 52 formed in key lever 40 and a second transverse grove 54 formed in whippen lever 42, defining a first floating pivot point 60, while lever bearing 50 is installed intermediate a transverse groove 56 formed in hammer lever 44 and second transverse grove 58 formed in whippen lever 42, defining a second floating pivot point 62. The lever bearings 48, 50 are thus formed, or constructed of a flexible material so that flexure can take place between the respective key lever 40 and whippen lever 42 and between the whippen lever 42 and the hammer lever 44. Preferably, the flexible material of the lever bearings 48, 50 is leather and is fitted within and secured by an adhesive to the various transverse grooves 52, 54, 56 and 58. Alternate materials can include, but are not limited to, polyvinyl chloride (PVC).

Key 18, key lever 40, whippen lever 42, and hammer lever 44 have complementary shapes: the rearward end of key lever 40 has a step-shaped recess 64 shaped to receive a corresponding rearward end 66 of hammer lever 44; the bottom surface of hammer lever 44 has a step-shaped recess 68 complementary to a rearward end 70 of whippen lever 42; and the forward end 72 of hammer lever 44 has a surface profile complementary to a surface portion 74 of key lever 40. Whippen lever 42 is pivotable on the main fulcrum rail 36, as will be described further below.

There is also located at the rearward end of the key lever 40, a key lever tail 76 that extends downwardly from the key lever 40 to provide a target for a sensor 32 such that the key lever tail 76 allows the motion of the key lever 40 to be picked up and interpreted by the sensor 32 that is located adjacent to the main joist 16.

Strips 78, 80 of polytetrafluoroethylene (TEFLON) or other suitable material, are attached, respectively to key lever 40 and whippen lever 42 generally as shown. Strips 78, 80 decrease friction, thereby reducing wear on those components of keyboard apparatus 10 which repeatedly strike each other during use, including that portion of the surface of key lever 40 which contacts hammer lever 44, and that portion of whippen lever 42 which pivots on main fulcrum rail 36. Felts 82 are attached to whippen lever 42 and hammer lever 44, and, together with felt downstop 34, serve to cushion those components of the keyboard apparatus 10 when keys 18 are struck. Felt downstop 34 and felts 82 may be made of any material that provides a degree of cushioning or buffering, including the type of felt used in acoustic pianos. The upper surface of main fulcrum rail 36 is preferably covered with a layer 84 of material that is at least somewhat compressible, such as TEFLON plastic coated tape. A weight 86 may be installed in the rearward end of each hammer lever 44, positioned generally as shown.

As also can be seen, each key 18 is provided with a means to stop upward movement after a key 18 has been struck and that up stop action can be provided by an extension 88 that is formed in the forward end 90 of the key lever 40 and a groove 92 formed in the forward end 90 so that there is a predetermined and desirable flexibility to the extension 88 extending outwardly therefrom. To complete the up stop function, there is a block 94 affixed to the horizontal base 14 and which may be affixed to the horizontal base by means such as glue. On the upper surface of the block 94 there is secured, preferably by means of a screw 98 an upstop strip 100, and which is preferably a strip of aluminum material. There may also be a felt 101 affixed to the lower surface of the upstop strip 100 to cushion the impact of the extension 88 when it strikes the upstop strip 100. As can be seen, however, when a key 18 returns to its upper position after having been struck by a user, the uppermost travel of the key 18 is stopped by the extension 88 that hits up against the upstop strip 100 to prevent further upward travel of the key 18. As also seen, there is a keyslip 102 that covers the front or forward area of the keyboard apparatus 10 and is normally a decorative component to provide a pleasing appearance to users.

Accordingly, in the operation of the keyboard apparatus 10, when the player depresses key 18, the forward end of the key 18 moves downwards from the rest position shown in FIG. 1A, bending support 22 slightly. Whippen lever 42 slides and pivots on main fulcrum rail 36, lifting the rearward end 66 of hammer lever 44 as the surface of the rearward end 66 of hammer lever 44 moves against surface portion 74, and throwing hammer lever 44 into recess 64 as shown in FIG. 1B. Support 22 functions analogously to the fulcrum or balance rail in a conventional acoustic piano action, allowing upward and downward movement of keys 18.

Figure 3:
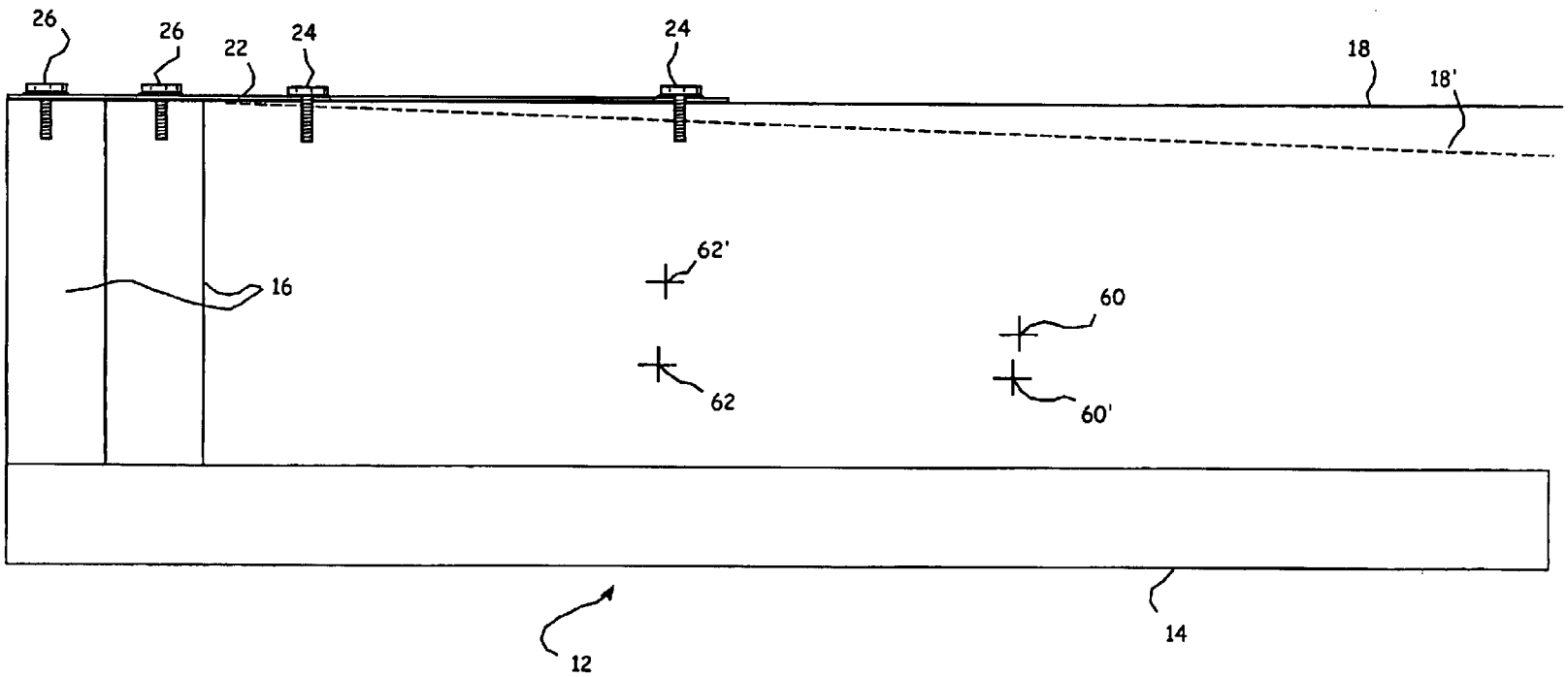
FIG. 3 shows the displacement of the pivot points during the downward key stroke.

Turning briefly to FIG. 3, the displacement of first and second floating pivot points 60, 62 during the downward keystroke is illustrated as the key 18 moves from the solid line, rest position of 18 to the dotted line or down position of 18', first and second floating pivot points 60 and 62 move from their rest positions to different, operative positions; first floating pivot point 60 moves from its rest position to a lower, slightly rearward position indicated by 60', and second floating pivot point 62 moves from its rest position to a higher, forward position indicated by 62'. The floating pivot points 60, 62 return to their rest positions as the key is released. The displacement of floating pivot points 60, 62, which is not found in conventional keyframe assemblies with fixed pivot points, is felt by the player and thereby contributes to the overall touch of keyboard apparatus 10. Furthermore, floating pivot points 60 and 62 are not spatially fixed as in a conventional keyboard structure, but rather move with the key itself. This feature of the invention allows the elimination of the conventional keyframe assembly found in other keyboard apparatus.

The relative movement of various components of keyboard apparatus 10 with respect to each other, combined with the cushioning effect of felt downstop 34 and layer 84 atop of main fulcrum rail 36, together provide a keyboard that largely replicates the touch of a conventional acoustic piano. As noted above, support 22 substantially eliminates any lateral or side-to-side movement of the keys, thereby maintaining proper spacing and key alignment while eliminating the washers and guide pins of a conventional keyboard to provide a "natural" feeling similar to that of a conventional acoustic piano keyboard.

Lever bearings 48 and 50 maintain key lever 40, whippen lever 42, and hammer lever 44 in relative alignment. Unlike conventional fixed hinges, lever bearings 48 and 50 are somewhat flexible, and permit a modicum of relative movement between key lever 40 and whippen lever 42, and between whippen lever 42 and hammer lever 44. This relative movement, referred to above as "hysteresis," replicates at least in part the touch of a conventional acoustic keyboard. This effect is further extended by the sliding motion between hammer lever 44 and key lever 40 and between whippen lever 42 and main fulcrum rail 36.

Figure 4:
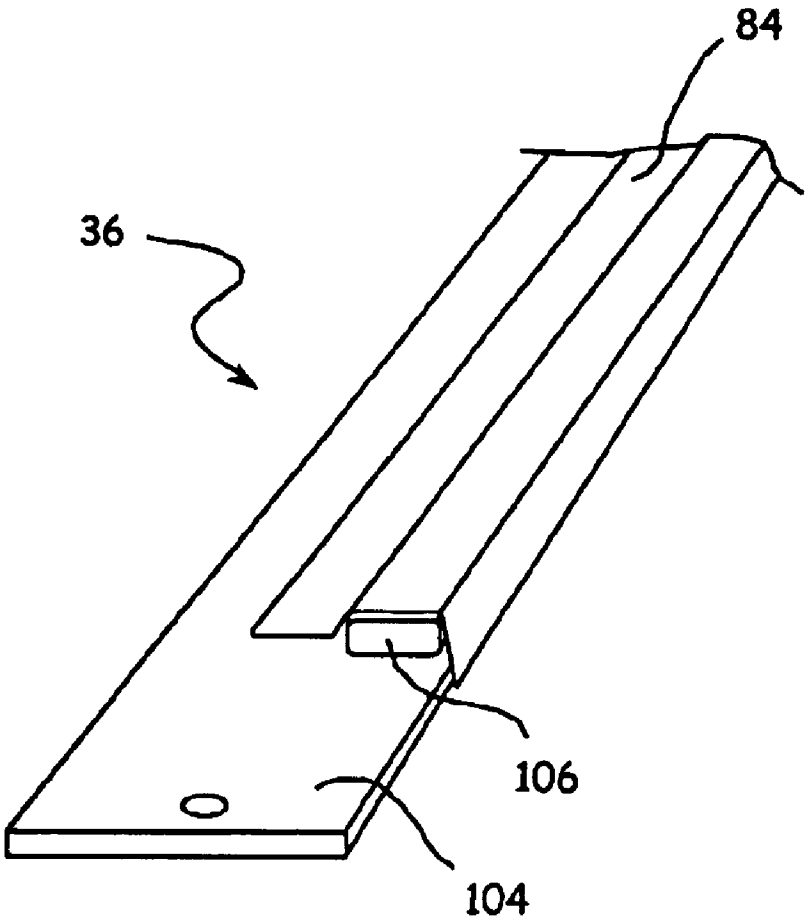
FIG. 4 is a perspective view of the main fulcrum rail of the apparatus of the present invention.
Figure 5:
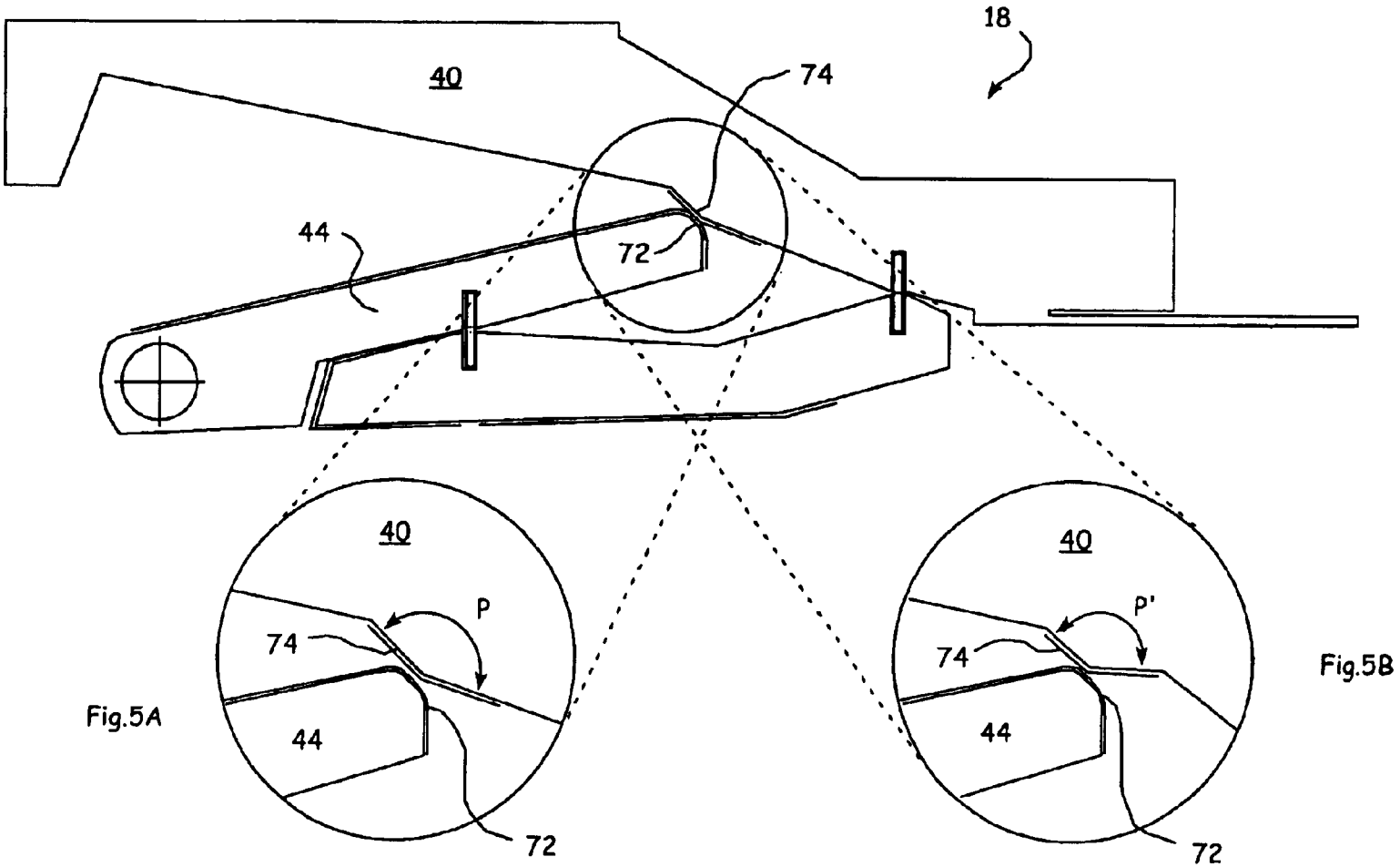
FIG. 5 is a side, partial cross-sectional view of the present apparatus of with detail views of the recess in FIG. 5A and the forward end of the hammer lever in FIG. 5B.

Turning now to FIG. 4, taken along with FIGS. 1A, 1B, 2A and 2B, there is shown a perspective view of the main fulcrum rail 36 used in the present invention. Whippen lever 42 pivots on main fulcrum rail 36 when its corresponding key 18 is struck. Main fulcrum rail 36 preferably includes a base 104 with a central rubber or felt strip 106, and is covered by a layer 84 of somewhat compressible material such as TEFLON plastic coated tape. Main fulcrum rail 36 may be made of aluminum, steel, or other suitable material.

Returning to FIGS. 1A, 1B, 2A and 2B, unlike known keyboard designs which have key-actions with fixed pivot points, main fulcrum rail 36 can be moved forwards or backwards with respect to horizontal base 14 as indicated by arrow A in FIG. 1A. Main fulcrum rail 36 may be substantially parallel to main joist 16; alternatively, either the treble end or the bass end of the main fulcrum rail 36 may be closer to main joist 16, that is, the orientation of the main fulcrum rail 36 may be at an angle with respect to the main joist 16. Main fulcrum rail 36 may be provided in a single section or a plurality of sections. For example, main fulcrum rail 36 may have one, two or three sections which together span the width of keyboard apparatus 10, and can be adjusted by any suitable means. A plurality of such main fulcrum rails 36, one per key 18, may be provided for maximum adjustability of keyboard apparatus 10.

Figure 2A:
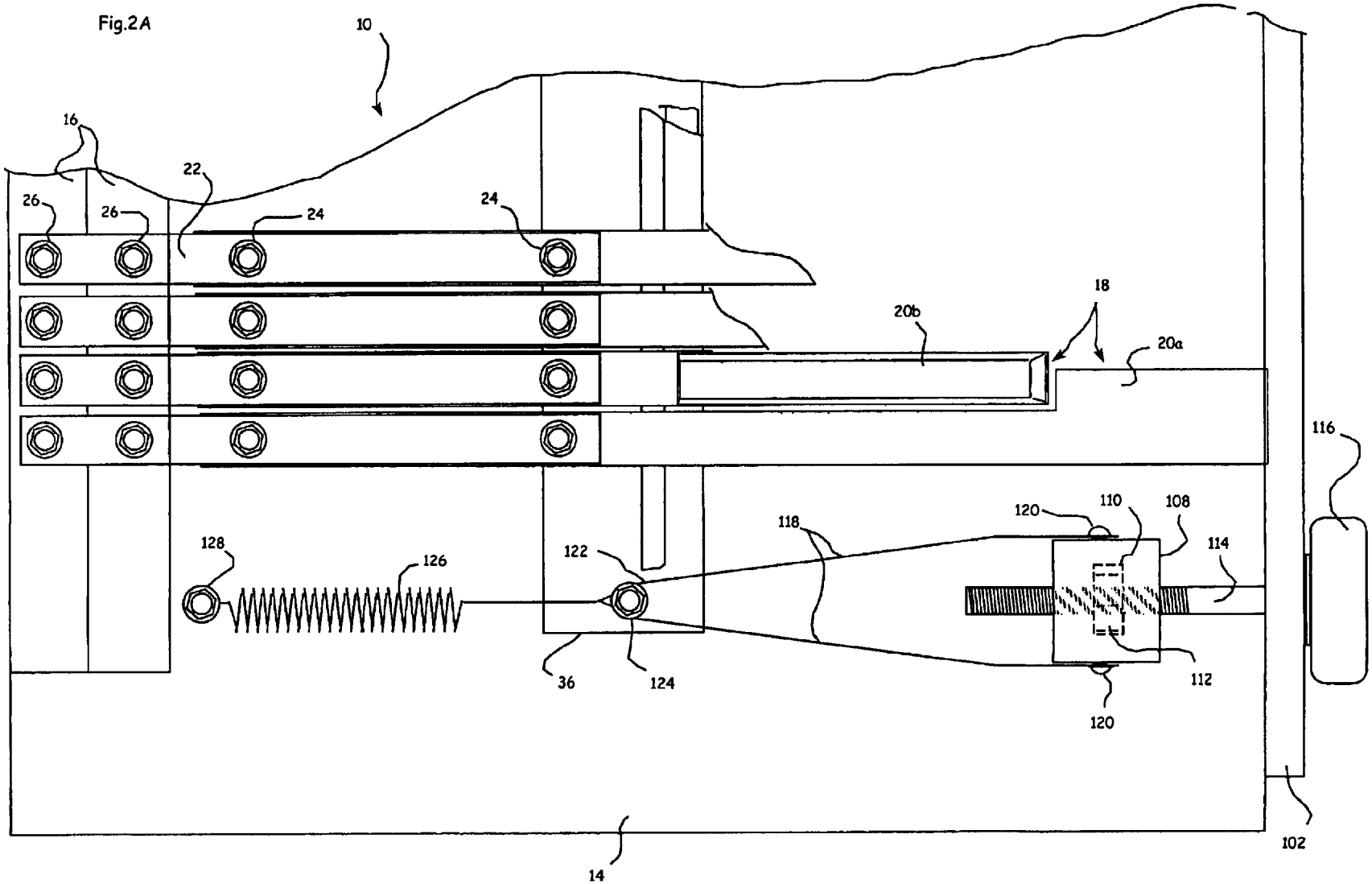
FIG. 2A is a top view of a portion of the adjustable keyboard apparatus of the present invention.
Figure 2B:
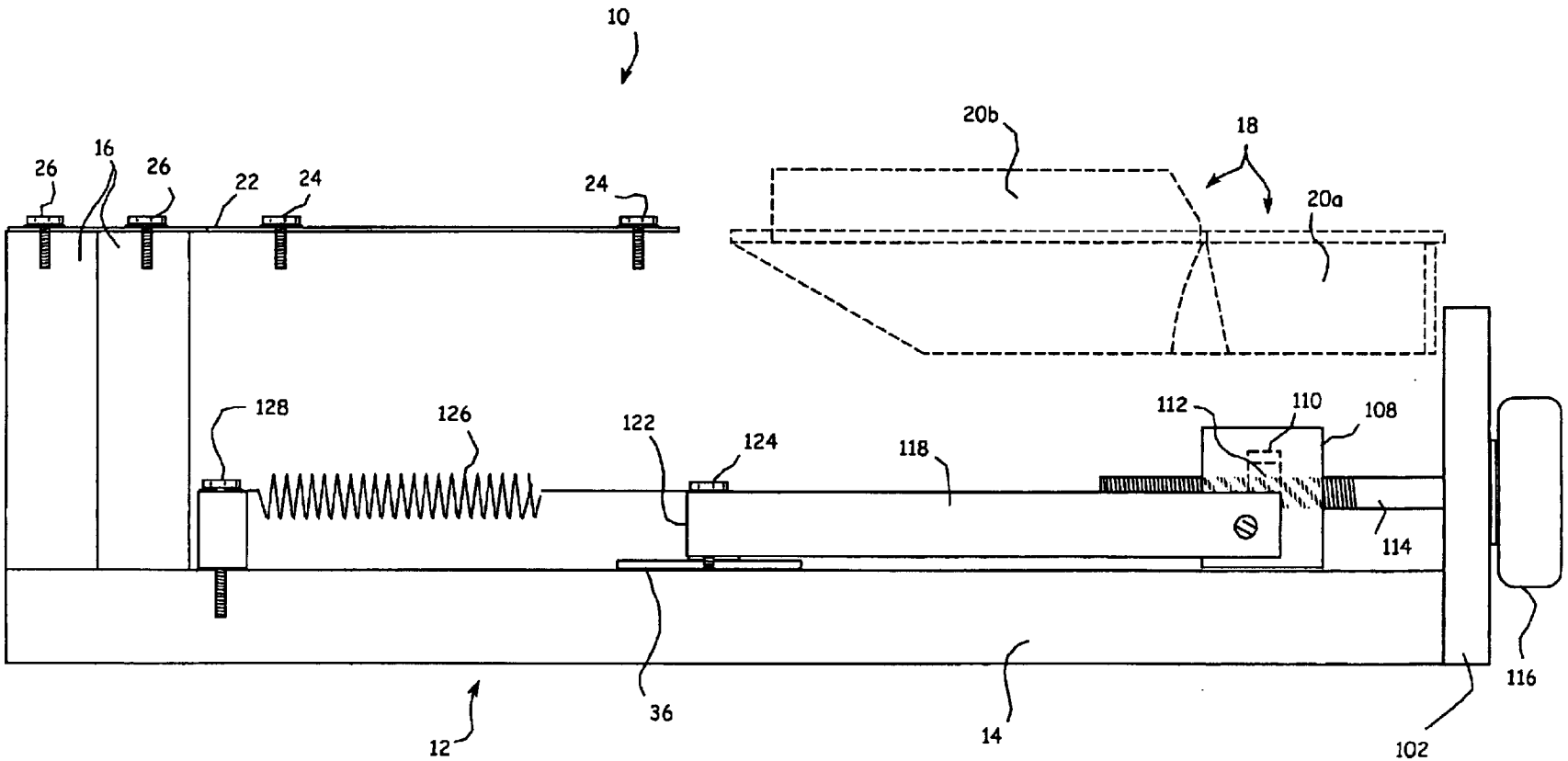
FIG. 2B is a side view of the adjustable keyboard apparatus of the invention.

In FIGS. 2A and 2B, there can be seen a mechanism for adjusting the location of the main fulcrum rail 36 with respect to the main joist 16, however, as will readily be understood, there can be may be different mechanisms for changing the location and orientation of the main fulcrum rail 36 that are suitable for carrying out the present invention. As can be seen, however, the adjusting mechanism comprises a movable block 108 located so as to rest upon or just off of the upper surface of the horizontal base 14. The movable block 108 can be constructed of wood and has an opening 110 formed therein where there is located a captive nut 112. Threadedly engaged with the captive nut 112 is a threaded carriage bolt 114 having a knob 116 that extends outwardly so as to be located external of the keyslip 102 and which is, therefore, accessible by a user of the keyboard apparatus 10.

Extending in the opposite direction from the knob 116 is a bifurcated steel box strap 118 that is affixed to the lateral sides of the movable block 108 by means such as screws 120 and has a distal looped end 122 that partially encircles a standoff screw 124 that is affixed to the main fulcrum rail 36. There is also a rearward bias exerted on the main fulcrum rail 36 by means of a spring 126 that extends between the standoff screw 124 affixed to the main fulcrum rail 36 and a further standoff screw 128 that is in a fixed location, such as being secured to the horizontal base 14.

Accordingly, as now can be readily understood, the user, by rotating the knob 116 of the carriage bolt 114 can move the movable block 108 either toward or away from the main joist 16, thereby making a corresponding move in the main fulcrum rail 36. By providing a plurality of such mechanisms, spaced apart along the length of the main fulcrum rail 36, the user can move the main fulcrum rail 36 to vary its position with respect to the main joist 16 while maintaining a parallel relationship with respect to the main joist 16 or can place the main fulcrum rail 36 at an angle with respect to the main joist 16, at the option of the user to customize the feel for the movement of the keys 18.

The distance between the center of main fulcrum rail 36 and first floating pivot point 60 defines a moment arm M (FIG. 1A). The response of keys 18 depends partly on the length of moment arm M, which at least partly defines a resistance to travel of the keys: a shorter moment arm increases the force or pressure that the user must apply to play a key, whereas a longer moment arm decreases this force. Thus, the overall feel of keyboard apparatus 10 can be adjusted by changing the position of main fulcrum rail 36 to change the length of moment arm M. In addition, the length of moment arm M may be changed by changing the dimensions of floating lever assembly 38, for example, the lengths of key lever 40 and whippen lever 42. This feature of the invention results from the elimination of the conventional chassis found in many keyboard instruments.

As best seen in FIGS. 5–5B and 6A–6D, the forward end 72 of each hammer lever 44 has a surface profile complementary to a surface portion 74 of its corresponding key lever 40. Surprisingly, the resistance to travel of keys 18 is determined at least in part by the shapes or profiles of the surface of forward end 72 of the hammer lever 44 and the surface portion 74 of a key lever 40. Thus, a frictional response of the corresponding key 18 can be altered by changing the contours of the surfaces of the forward end 72 of the hammer lever 44 and the surface portion 74 of key lever 40 and thereby change the properties of the tactile feel of the movement of the key 18 as it moves upwardly and downwardly.

By way of example, in the magnified view of FIG. 5A, there is shown that the surface portion 74 of the key lever has an angular profile, that is, there is an angle P of the profile and, as can be seen, the angle P is shallower, or less abrupt than the angle P' of the magnified view of FIG. 5B. As such the feel of the movement of a key 18 is determined by the sliding action of the forward end 72 of the hammer lever 44 along the surface portion 74 of the key lever 40. Thus, if the angle P were 180 degrees, or a straight surface, the forward end 72 of the hammer lever 44 would simply slide along the surface portion 74 without any real change in resistance of the key action by a user.

With the relatively shallow angle P of FIG. 5A, the will be a slight decrease in key resistance as the forward end 72 reaches the apex of the angle and then an abrupt drop in resistance as the key 18 continues to be pushed downwardly by the user. Further downward movement of the key 18 by a user will experience a continued gradual decrease in resistance.

With the more abrupt angle P', three will also be an initial less gradual drop in key resistance than the with a shallow angle P, but when the forward end 72 of the hammer lever 44 passes over the apex of the angle P', there will thereafter be a more rapid decrease in key resistance than with the shallower angle P since the forward end 72 of the hammer lever 44 is sliding along a more horizontal profile.

In FIGS. 6C and 6D, there can be seen curves representing key resistance vs. key travel for the profiles, respectively shown in FIGS. 6A and 6B and illustrating the effect of the differing profiles on the resistance to the movement of a key as the key is displaced by the user. As can be seen, the key resistance in the FIG. 6A profile represented by the FIG. 6C curve, shows the initial gradual reduction in key resistance, an abrupt drop in key resistance as the forward end 72 of the hammer lever 44 passes over the apex of the angle P and thereafter a continued gradual drop in key resistance. With FIG. 6B and its corresponding curve of FIG. 6D, it can be seen that there is, again, a gradual decrease of key resistance followed by a more abrupt drop in key resistance due to the more abrupt angle over which the forward end 72 passes, and thereafter a more rapid reduction in key resistance since the forward end 72 is basically sliding along a near horizontal profile along the surface portion 74 of key lever 40.

Different surface profiles may, of course, produce different results, so the optimum structures of the profile of the forward end 72 of hammer lever 44 and the surface portion 74 of key lever 40 are best determined by a modest amount of experimentation and observation to achieve the desired feel of a key 18 to a user. This feature of the invention also furthers the natural feel of keyboard apparatus 10 when played, helping replicate the feel of a conventional acoustic piano keyboard for the player.

Figure 7A:
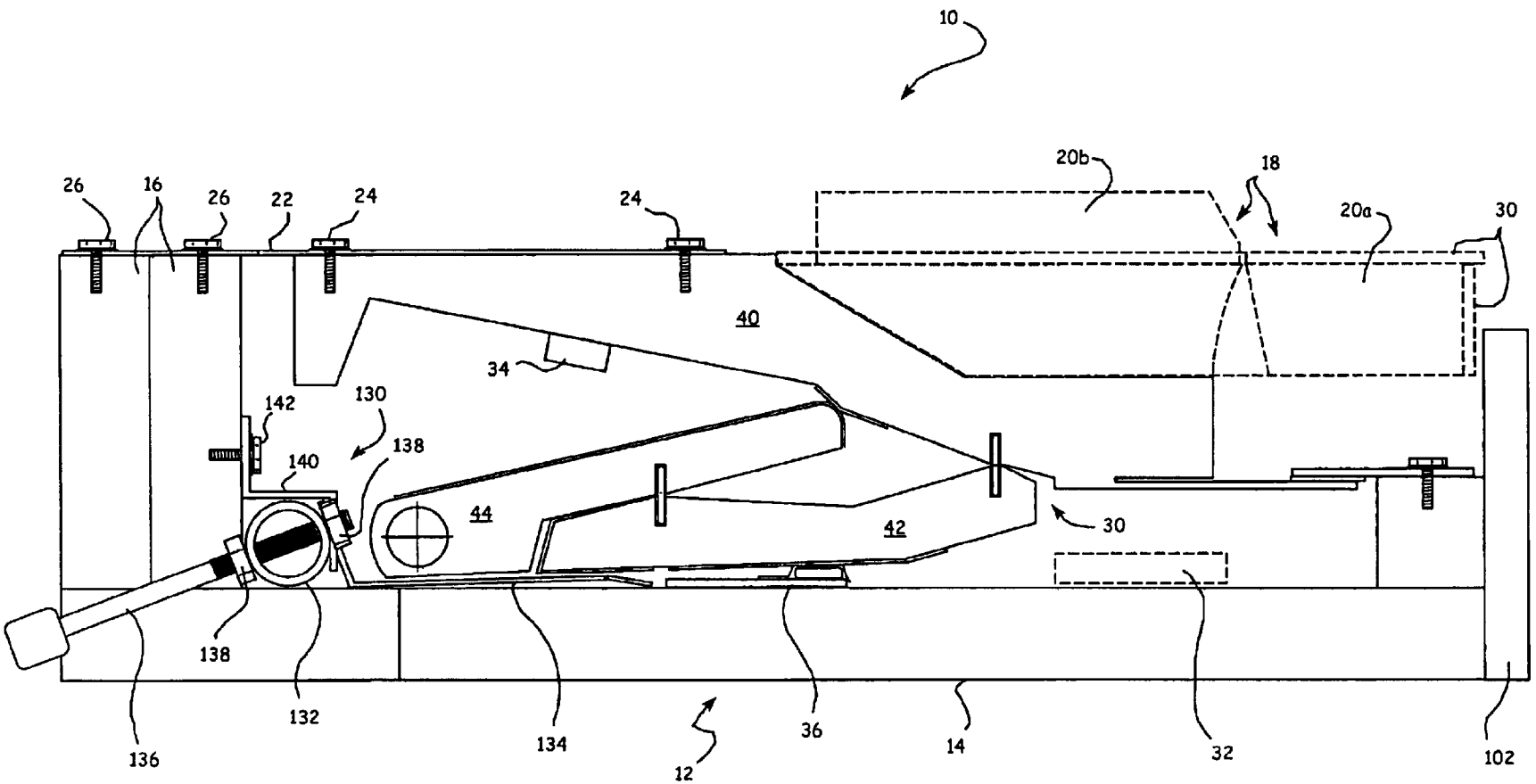
FIG. 7A is a side, partial cross-sectional view of a keyboard apparatus according to another preferred embodiment of the present invention, showing a lifting mechanism in the down position.
Figure 7B:
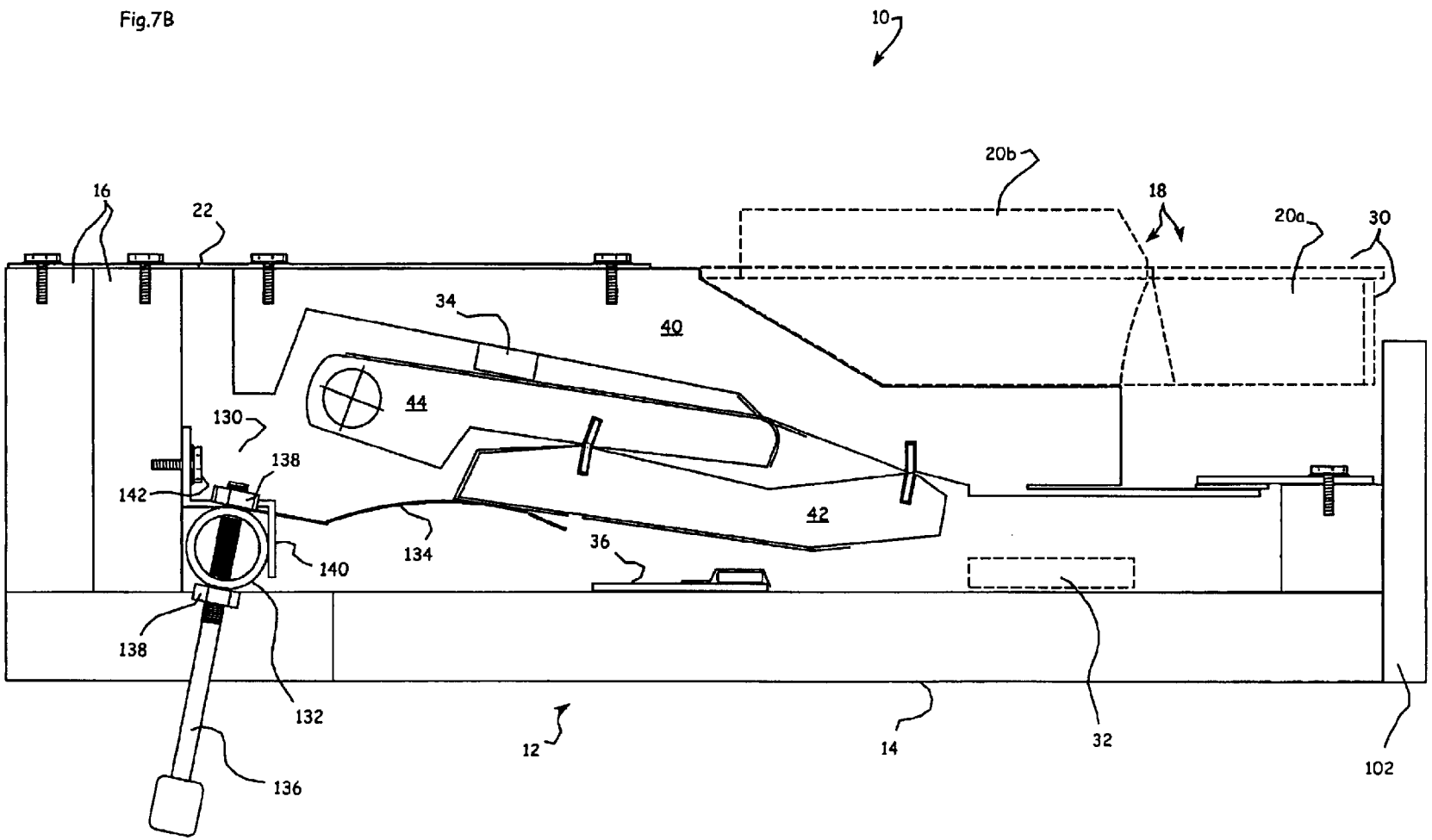
FIG. 7B shows the apparatus of FIG. 7A with the lifting mechanism in the raised position.
Figure 7C:
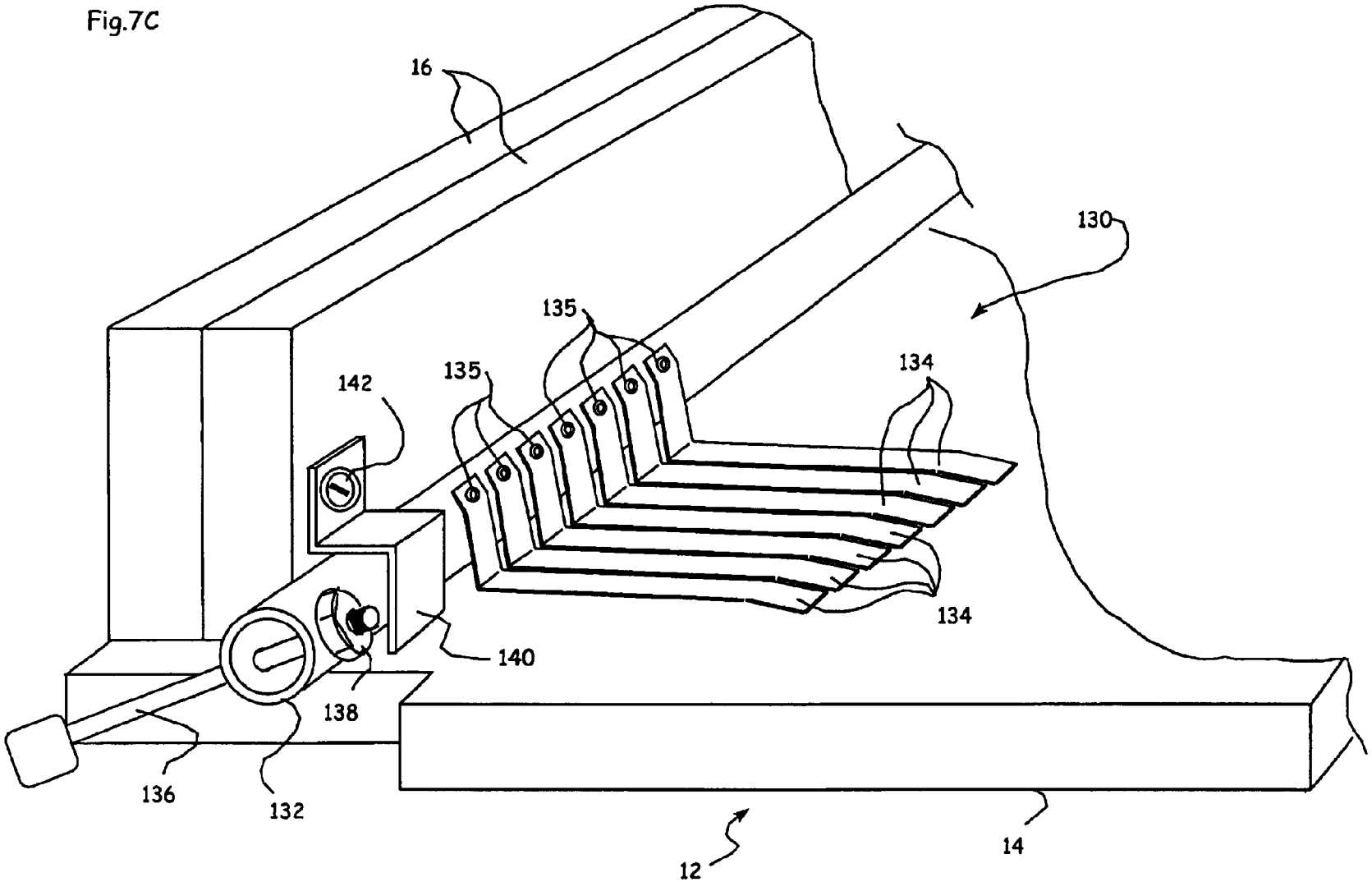
FIG. 7C is a perspective view of the lifting mechanism of FIGS. 7A and 7B.

In FIGS. 7A–7C, there is shown another embodiment of the present invention. In this embodiment, the keyboard apparatus 10 is provided with a lifting mechanism 130 that is operable to change the feel of the key action to a player. Lifting mechanism 130 includes a cylindrical pipe 132 that carries a plurality of fingers 134. As can be seen, specifically in FIG. 7C, the fingers 134 can be affixed to the cylindrical pipe 132 by means such a screws 135 or other fastening devices. The fingers 134 are bent so as to extend in a generally outward direction from the cylindrical pipe 132. A lever 136 is affixed to the cylindrical pipe 132 and that affixation may be by passing an end of the lever 136 through holes formed in the cylindrical pipe 132 and then securing the cylindrical pipe 132 and lever 136 together by the use of nuts 138.

Accordingly, as can be seen, by moving the lever 136, one can thereby rotate the cylindrical pipe 132. The cylindrical pipe 132 is rotationally secured to the main joist 16 by one or more S-shaped brackets 140 that are, in turn, secured to the main joist 16 through the use of screws 142 (only one of such brackets 140 and screws 142 are shown). Each finger 134 corresponds to one of keys 18.

In a "neutral" or rest position shown in FIG. 7A, fingers 134 rest on horizontal base 14 and keys 18 operate as described above. When lever 136 is moved downwardly, the cylindrical pipe 132 rotates counterclockwise to raise fingers 134 to a raised position shown in FIG. 7B, lifting floating lever assembly 38 so that whippen lever 42 no longer contacts main fulcrum rail 36. Whippen lever 42 and hammer lever 44 are held against the bottom of key 18. When the player depresses a key 18 with lifting mechanism 130 in the raised position, the player experiences a very smooth response and spring-like response since the floating lever action is removed and the inertial type of response of a key 18 is turned into the loaded spring type of response that is similar to the action of an organ. When lifting mechanism 130 is in the down position, the overall feel of keyboard apparatus 10 is similar to that of a "thrown weight" acoustic keyboard; when lifting mechanism 130 is in the raised position, the feel resembles that of an organ or synthesizer keyboard.

In FIG. 7C, there is shown a perspective view of lifting mechanism 130 installed on frame assembly 12 (for clarity, keys 18, floating lever assembly 38, and other components of keyboard apparatus 10 are not shown). Cylindrical pipe 132 may extend substantially across the width of keyboard apparatus 10, with each key 18 associated with a corresponding finger 134. Alternatively, the cylindrical pipe 132 may have fingers 134 operably connected to selected keys 18, and be dimensioned accordingly. For example, lifting mechanism 130 may operate on the bass, treble, or mid-range keys of keyboard apparatus 10, or some other combination of keys as may be preferred.

Figure 8:
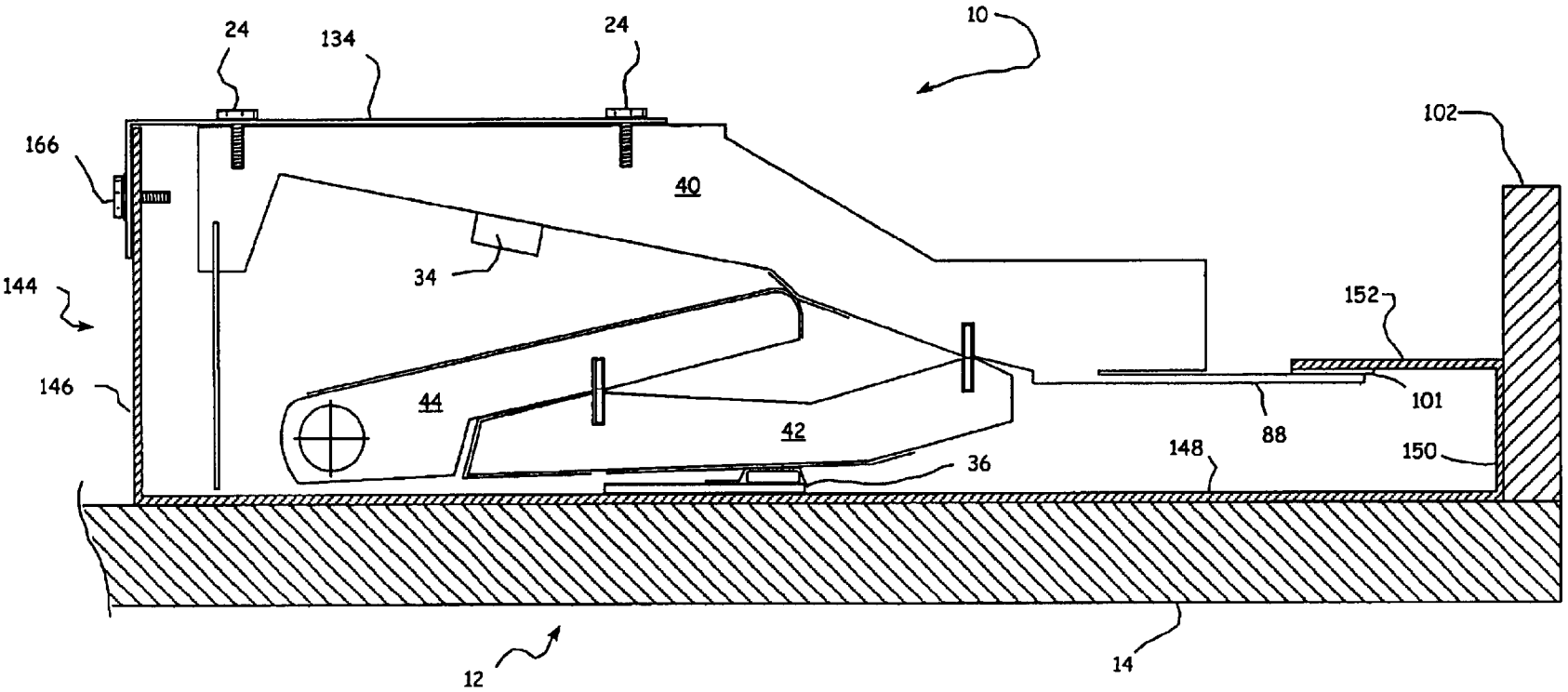
FIG. 8 is a side view of an alternative embodiment of the present invention.

Turning now to FIG. 8, there is shown an alternative embodiment of the present invention and where the overall keyboard apparatus 10 can be reduced in size i.e. a shorter keyboard depth from front to back for use in a more restrictive enclosure and thereby have additional room for further electronics or provide easier transportation and storage. In this embodiment, some of the wooden, and therefore heavy, components have been replaced with a metal frame 144, preferable a steel frame. Thus, the metal frame comprises a rear plate 146, a bottom plate 148, a front plate 150 and a rearwardly directed lip 152. The reference to the various plates is only for purposes of fully describing and illustrating the metal frame 144 since the metal frame 144 could, of course, be constructed from a unitary piece of metal that is stamped or bent to the configuration shown in the FIG. 8. Alternatively, the metal frame 144 may be constructed of two or more separately formed plates that are joined together.

In any event, it can be seen that the metal frame 144 can enclose and support the various components previously described and the support 22 can have a 90 degree bend so as to affix the support 22 to the rear plate 146 by means of a screw 154. The bottom plate 148 can lie on the horizontal base 14 and be secured thereto while the front plate 150 extends upwardly from the bottom plate 148 such that the decorative keyslip 102 can be affixed to the front plate 150 to provide a pleasing appearance.

The rearward lip 152 acts as the upstop in place of the upstop strip 100 of FIGS. 1A and 1B, since the extension 88 of the key lever 40 abuts against the underside of the rearward lip 152 to limit the further upward travel of the key lever 40 and, therefore of a key 18. Again, there may be a felt 101 to cushion the contact between the extension 88 and the forward lip 152.

Figure 9:
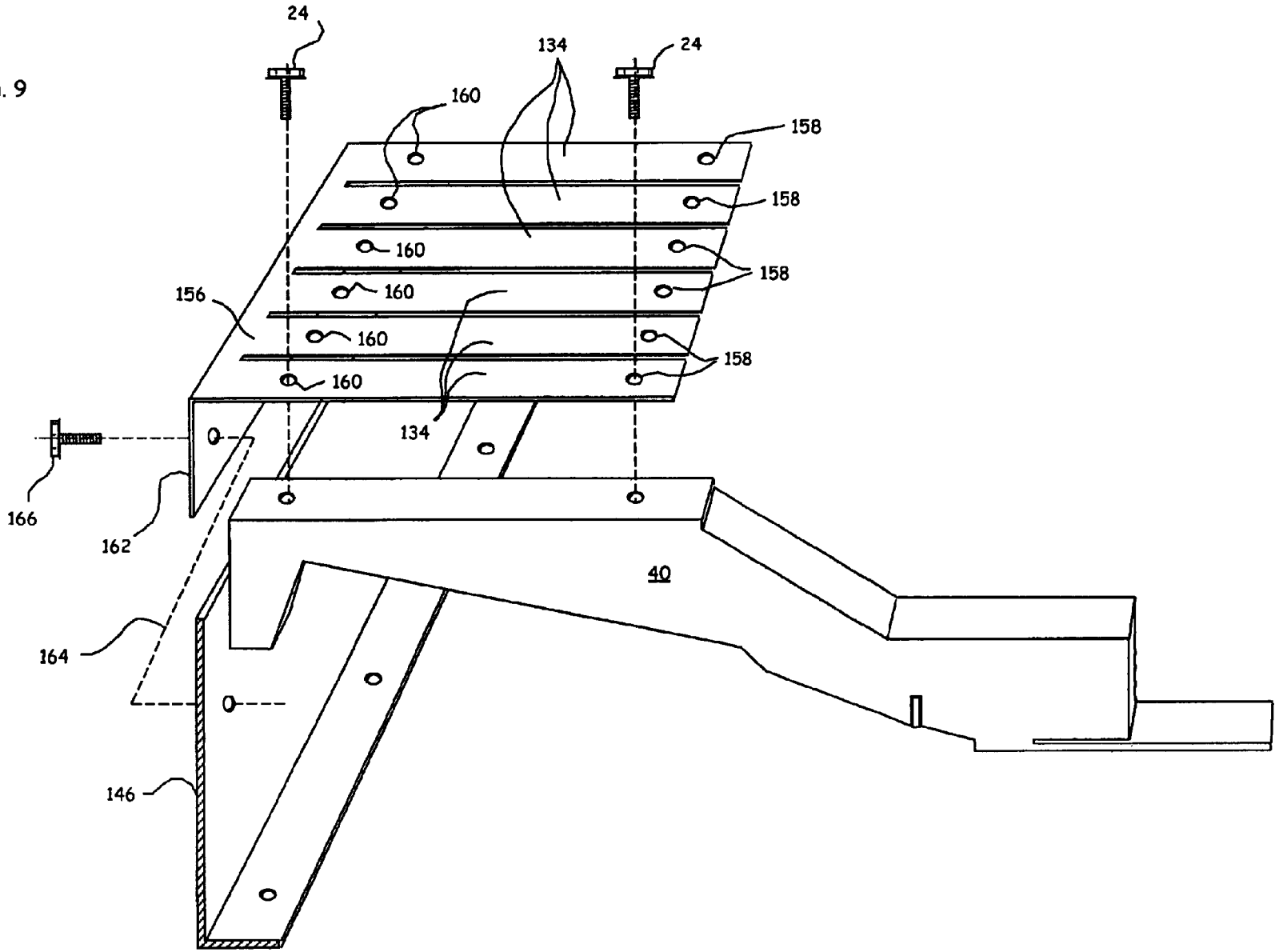
FIG. 9 is a perspective view of an alternative mechanism that can be used with the present invention.

Turning finally to FIG. 9, there is a perspective view of an alternative embodiment of the present invention and where there is a comb-like piece 156 that has multiple slits so as to have formed therein a plurality of support members 134 each of which have a forward hole 158 and a rearward hole 160 to accept screws 24 to secure each of the individual support members 134 to a key lever 40. In this embodiment, the comb-like piece 156 has a rearwardly bent portion 162 that is secured to the rear plate 146 by means of a opening 164 through which is inserted a screw 166. As such, with this embodiment, the comb like piece 156 can be used to support a plurality of key levers 40 assemblies such as six keys of an octave of piano keys, and therefore, one comb-like piece 156 can accommodate notes C thru F and another group accommodates F# through B. By the use of the comb-like piece 156, therefore, the comb like piece 156 can be secured to the rear plate 46 with considerably fewer screws than with the individual supports 22 of the FIGS. 1A and 1B embodiment, thereby simplifying the construction procedures. By making sure the slits do not extend all the way to the bent portion 162, the support members 134 still allow the up and down flexing movement of the keys yet retain the needed side to side stability for the keys.

Keyboard apparatus 10 as described above is simple and easy to manufacture. Indeed, the major components of the keyboard apparatus can be made of wood, metal, plastic or suitable composite materials. If components such as lever assembly 38 is made of wood, these components can readily be manufactured using only "X-Y" cuts; no complex three-dimensional cuts are needed. Frame 12 consists of two blocks of wood or other suitable material (i.e., base 14 and main joist 16). Keyboard apparatus 10 is also economical to manufacture.

With respect to the above description of the invention, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A keyboard apparatus, comprising:

a frame assembly;

a fulcrum rail extending across at least a portion of said frame assembly; and a plurality of linearly arranged floating lever assemblies mounted to said frame assembly, each of said floating lever assemblies comprising a key lever adapted to be depressed and released by a user, a whippen lever pivotable on said fulcrum rail and pivoted to said key lever at a first pivot point and a hammer lever pivoted to said whippen lever at a second pivot point, each of said first and second pivot points moving from a rest position to an operative position when said corresponding key lever is depressed, said first and second pivot points returning to said rest positions when said corresponding key lever is released.

2. The keyboard apparatus as recited in claim 1, further comprising:

a first flexible bearing hingedly connecting said key lever to said whippen lever at said first pivot point; and a second flexible bearing hingedly connecting said whippen lever to said hammer lever at said second pivot point.

3. The keyboard apparatus as recited in claim 2, wherein said first pivot point and said fulcrum rail define a moment arm, and wherein a length of said moment arm is variable to vary a resistance to travel of said corresponding key lever.

4. The keyboard apparatus as recited in claim 3, wherein the keyboard apparatus includes a mechanism to manually move the fulcrum rail with respect to said first pivot point.

5. The keyboard apparatus as recited in claim 4, wherein said mechanism includes a knob located external of the frame assembly to enable a user to operate said mechanism.

6. The keyboard apparatus as recited in claim 1, further comprising friction-reducing means operably connected to at least one of said floating lever assemblies.

7. The keyboard apparatus as recited in claim 1, further comprising means defining an interface between each of said key levers and a corresponding one of said floating lever assemblies, said interface-defining means at least partly defining a resistance to travel of said corresponding key lever so that changing a shape of said interface-defining means changes said resistance to travel.

8. The keyboard apparatus as recited in claim 1, further comprising lifting means operable to lift at least some of said plurality of floating lever assemblies from a down position wherein said floating lever assemblies contact said fulcrum rail to a raised position wherein said lever assemblies are spaced apart from said fulcrum rail.

9. The keyboard apparatus as recited in claim 8 wherein said lifting means includes a plurality of fingers adapted to underlie said plurality of floating lever assemblies, said fingers being movable to move said lever assemblies between said down and said raised positions.

10. The keyboard apparatus as recited in claim 1 further comprising a plurality of keyswitch sensors associated with said keyboard apparatus to sense the movement of said key levers.

11. The keyboard apparatus as recited in claim 1, wherein at least a portion of said fulcrum rail is movable.

12. The keyboard apparatus as recited in claim 1 wherein the frame assembly is comprised of a metal frame.

13. A method for making a keyboard apparatus, comprising:

fabricating a plurality of floating lever assemblies, wherein each of said lever assemblies includes a depressible key lever, a whippen lever pivoted to said key lever at a first pivot point, and a hammer lever pivoted to said whippen lever at a second pivot point installing a fulcrum rail across at least a portion of a frame assembly;

installing the plurality of floating lever assemblies to the frame assembly so that each of said lever assemblies is linearly aligned and said whippen lever is pivotable on said fulcrum rail when said corresponding key lever is depressed.

14. The method as recited in claim 13 further comprising positioning said key lever, said whippen lever, and said hammer lever so that each of said first and second pivot points moves from a rest position to an operative position when said corresponding key is depressed.

15. The method as recited in claim 13, wherein said first pivot point and said fulcrum rail define a moment arm, and wherein a length of said moment arm is variable to vary a resistance to travel of said corresponding key lever.

16. The method as recited in claim 13 wherein said whippen lever, said key lever, and said hammer lever are fabricated using X-Y cuts.

17. The method as recited in claim 13 further comprising;

installing a flexible bearing hingedly connecting said key lever to said whippen lever at said first pivot point; and installing a second flexible bearing hingedly connecting said whippen lever to said hammer lever at said second pivot point.

18. The method as recited in claim 13 further comprising installing friction-reducing means operably connected to at least one of said floating lever assemblies.

19. The method as recited in claim 13 further comprising forming an interface between each of said key levers and a corresponding one of said floating lever assemblies, said interface at least partly defining a resistance to travel of said key lever so that changing a shape of said interface changes said resistance to travel.

20. The method as recited in claim 13, further comprising installing lifting means operable to lift at least some of said plurality of floating lever assemblies from a down position wherein said lever assemblies contact said fulcrum rail to a raised position wherein said lever assemblies are spaced apart from said fulcrum rail.

* * * * *